US005186265A

United States Patent [19]

Henson et al.

[11] Patent Number: 5,186,265

[45] Date of Patent: Feb. 16, 1993

[54] RETRIEVABLE BIT AND ECCENTRIC REAMER ASSEMBLY

[75] Inventors: Randy H. Henson; Lloyd A. Baillie, both of Plano, Tex.

[73] Assignee: Atlantic Richfield Company, Los Angeles, Calif.

[21] Appl. No.: 748,410

[22] Filed: Aug. 22, 1991

[51] Int. Cl.[5] ..... E21B 4/02; E21B 10/32; E21B 10/66

[52] U.S. Cl. ..... 175/107; 175/258; 175/273; 175/292

[58] Field of Search ..... 175/107, 292, 257, 258, 175/260, 261, 273, 384, 406

[56] References Cited

U.S. PATENT DOCUMENTS

| | | | |
|---|---|---|---|
| 3,318,387 | 5/1967 | Jones | 175/318 X |
| 3,416,616 | 12/1968 | Ahlgren | 175/258 |
| 3,894,590 | 7/1975 | Takans et al. | 175/107 |
| 4,133,396 | 1/1979 | Tschirky | 175/57 |
| 4,262,762 | 4/1981 | Potratz | 175/401 |
| 4,616,719 | 10/1986 | Dismukes | 175/107 X |
| 4,646,856 | 3/1987 | Dismukes | 175/107 X |
| 4,651,837 | 3/1987 | Mayfield | 175/260 |
| 4,770,259 | 9/1988 | Jansson | 175/258 |
| 4,856,582 | 8/1989 | Smith et al. | 166/98 |
| 4,875,531 | 10/1989 | Biehl et al. | 175/107 X |

*Primary Examiner*—Hoang C. Dang
*Attorney, Agent, or Firm*—Michael E. Martin

[57] ABSTRACT

A retrievable drill bit and cutter or reamer assembly includes a fluid-drive motor, an eccentric cutter part and a concentric bit in assembly and insertable in and retrievable from the interior of a drill stem without removing the drillstem from a wellbore. The eccentric cutter is disposed on a shaft connected to the output shaft of the motor and journals an accentric cylindrical bearing member mounted on the shaft. In response to rotation of the shaft in one direction, the cutter part is displaced into a position to enlarge the wellbore to permit progress of the drillstem therethrough and in response to rotation in the opposite direction, the cutter centers itself to permit retrieval of the bit assembly throught the drillstem. The fluid-driven motor engages locking splines on a sub at the lower end of the drillstem and may be inserted in and retrieved from the drillstem by drilling fluid in forward and reverse circulation, respectively.

7 Claims, 2 Drawing Sheets

RETRIEVABLE BIT AND ECCENTRIC REAMER ASSEMBLY

BACKGROUND OF THE INVENTION

1. Field of the Invention

The present invention pertains to a retrievable motor-driven bit and reamer assembly for use in drilling with well casing or drill pipe wherein the bit and reamer assembly may be retrieved without removing the casing or drill pipe from the wellbore.

2. Background

Conventional rotary drilling operations require relatively frequent withdrawal of the elongated sectionalized drillstem or "drillstring" from the wellbore to inspect or replace the bit or portions of the drillstem, to perform well logging and to install permanent well casing. This insertion and withdrawal process is time-consuming, hazardous to operating personnel and increases the possibility of damaging the well due to inadvertent dropping of the drillstring into the wellbore or encountering the influx of formation fluids into the wellbore due to the swabbing effect encountered during drillstring insertion and removal processes.

A co-pending patent application Ser. No. 07/744,852 filed Aug. 14, 1991, assigned to the assignee of the instant invention, entitled "Drilling With Casing and Retrievable Drill Bit" and filed in the name of Richard E. Leturno is directed to one improvement in retrievable drill bits with reamer or cutter arms which enlarge the wellbore to accommodate the drillstem but which may be retracted to permit retrieval of the bit assembly through the drillstem without removing the drillstem from the wellbore. The improvements described in the above-referenced patent application are particularly useful, as with the present invention, for operations in so-called drilling with casing or drill pipe which is left in the wellbore to form a casing or support structure. The present invention provides another retrievable bit assembly which utilizes a unique mechanism for providing eccentric cutting action to enlarge the wellbore to permit movement of the drill pipe or casing into the wellbore behind the bit.

SUMMARY OF THE INVENTION

The present invention provides a unique retrievable drill bit assembly including a reaming or undercutting portion which is movable between cutting and retracted positions through rotation of the bit and a drive shaft portion therefor. In accordance with an important aspect of the present invention, an eccentric bearing and cutting member are supported on a shaft behind the primary or pilot bit for enlarging the wellbore to permit passage of the drill pipe or "casing" through the wellbore while at the same time permitting removal or retrieval of the bit and cutter from the wellbore without removing the drillstem.

The present invention further provides a bit and motor assembly which may be inserted into a wellbore and retrieved therefrom by pumping the bit and motor assembly down through a drillstem with drilling fluid or other insertion means and by retrieving the bit and motor assembly through reverse circulation of drilling fluid.

In accordance with another important aspect of the present invention, there is provided a retrievable bit and motor assembly for drilling with drill pipe or casing which is left in the wellbore wherein the bit has an eccentric cutting or reaming portion which may be moved from a working position to a retrieving position by circulation of drilling fluid through the wellbore in a reverse mode. The motor housing is advantageously engageable with a drillstem sub by cooperating interfitting splines and a fluid-flow-restricting seal. Reverse fluid circulation is controlled by a check valve and a motor inlet port restriction to permit pumping the motor and bit assembly up the drillstem for retrieval.

The bit and motor assembly of the present invention permits drilling with casing and retrieval of the drill bit without retrieval of the casing or drill pipe from the wellbore. The eccentric reaming or cutting portion of the bit assembly which acts as a hole-enlarging mechanism provides for drilling operations which generate less friction and less torque as compared with certain other types of cutting or reaming mechanisms. The rotation of the pilot or centralized bit with the eccentric cutting or hole-enlarging bit portion at the same speed improves stability of the mechanism. The mechanism may be utilized in generally vertical as well as curved or generally horizontal wellbores. The mechanism utilizes relatively few parts and may be inserted in and withdrawn from the drillstring with relative ease.

The above-described features and advantages of the present invention, together with other superior aspects thereof will be further appreciated by those skilled in the art upon reading the detailed description which follows in conjunction with the drawing.

DESCRIPTION OF PREFERRED EMBODIMENTS

Figure 1:
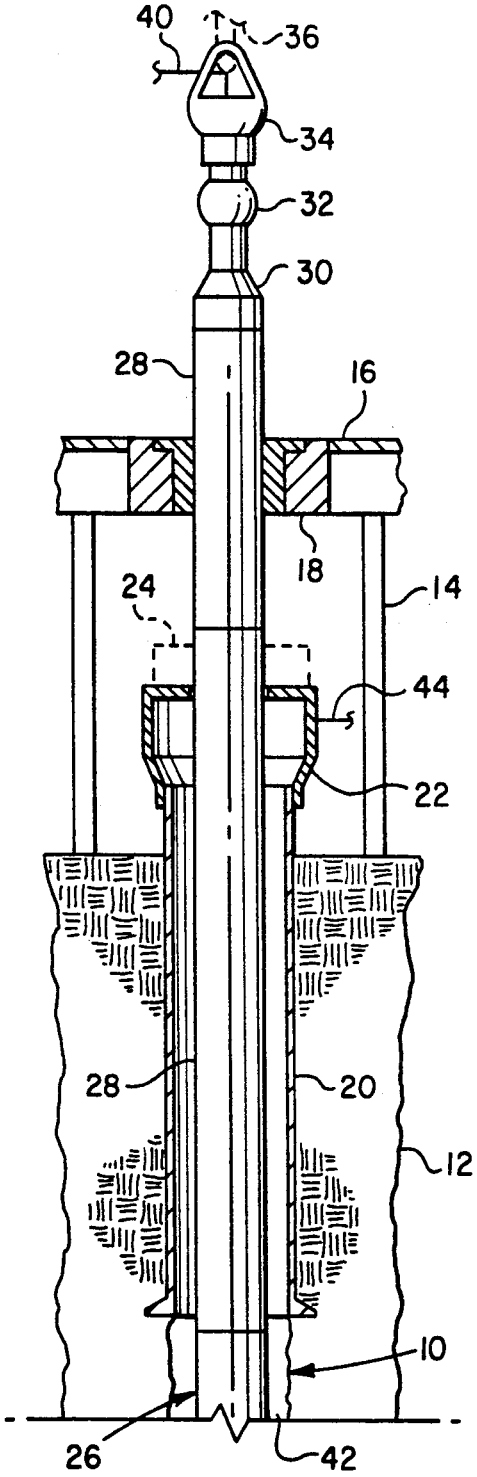
FIG. 1 is a schematic view of a portion of a drillstring comprising a well casing in a working position for drilling a wellbore with a conventional rotary drilling rig.

In the description which follows, like parts are marked throughout the specification and drawing with the same reference numerals, respectively. The drawing figures are not to scale and certain features of the invention are shown in somewhat schematic form in the interest of clarity and conciseness.

Referring to FIG. 1, there is illustrated a wellbore 10 being drilled into a formation 12 utilizing a conventional drilling rig 14 having a main deck 16 supporting a rotary table 18 thereon. A surface pipe or casing 20 has already been installed in the wellbore 10 and is fitted at its top end with a bell nipple 22 and, when needed, a diverter 24. The well 10 is being drilled with a drillstem 26 which may comprise a relatively large-diameter pipe known as "casing" which will be left in the wellbore and not removed therefrom during drilling operations. The drillstem 26 is made up of sectionalized lengths of pipe or casing 28 which are suitably coupled together in a conventional manner. The upper end of the drillstem 26 includes a pipe or casing section 28 which is connected to a reducer or cross-over sub 30, a kelly-cock 32 and a swivel 34. The drillstem 26 is suspended from a conventional block-and-tackle assembly, not shown, including a hook 36 connected to the swivel. Drilling fluid is conducted down through the interior of the drillstem 26 from a source, not shown, by way of a conduit 40 and is circulated up through the annular area 42 formed between the wellbore 10 and the drillstem 26 and to a conditioning system, also not shown, by a suitable conduit 44 connected to the bell nipple 22. Drilling fluid may be circulated in a reverse manner, that is by way of the conduit 44 and the bell nipple 22 down through the annular area 42, if the diverter 24 is actuated to prevent leakage of fluid out of the top of the bell nipple. During reverse circulation, fluid would circulate up through the interior of the drillstem 26 and the swivel 34 to the conduit 40. Reverse fluid circulation is advantageously utilized in connection with the present invention as will be explained in further detail herein.

Figure 2:
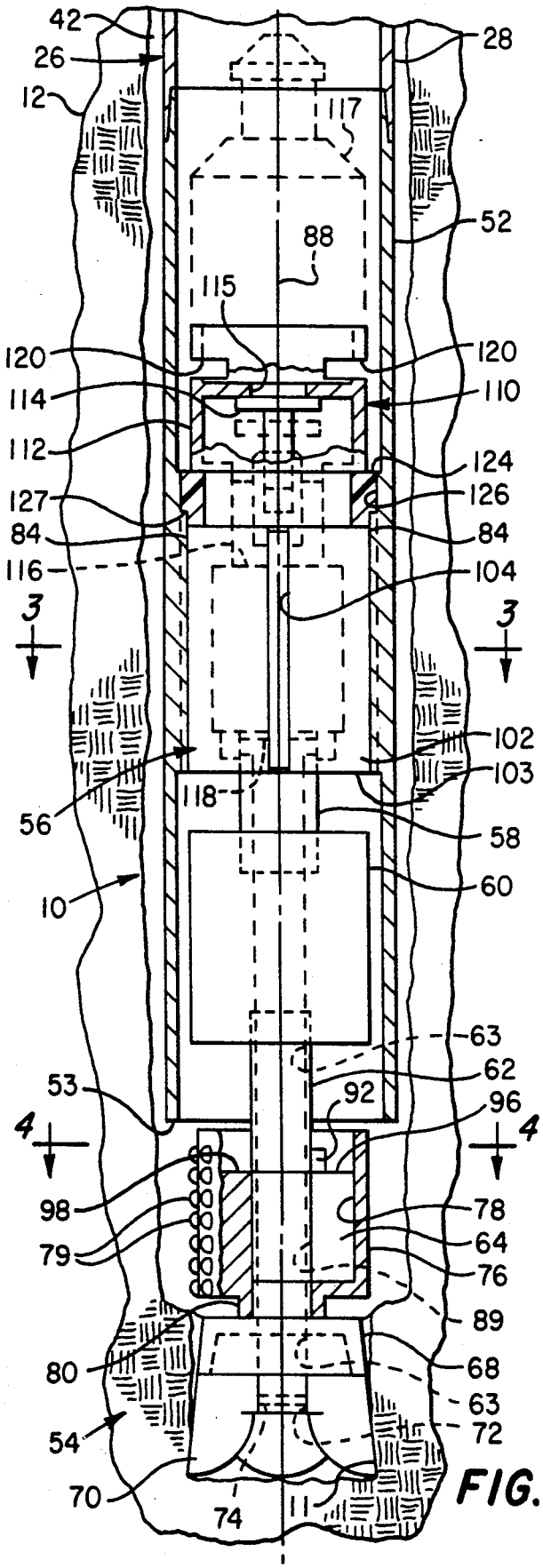
FIG. 2 is a detail vertical section view of part of the wellbore of FIG. 1 showing the retrievable motor-driven bit and cutter assembly of the present invention.

Referring now to FIG. 2, the lower end of the drillstem 26 includes a sub 52 which is connected to the lowermost drillstem section 28 in a conventional manner. The sub 52 supports a retrievable drill bit and cutter or reamer assembly, generally designated by the numeral 54, for operation to form the wellbore 10 ahead of the drillstem 26 in such a way that the annular area 42 is formed and the drillstem 26 may be inserted in and progress through the wellbore but not, if desired, withdrawn therefrom. In particular, the bit assembly 54 is retrievable from the lower end of the drillstem 26 without removing it from the wellbore.

The retrievable bit assembly 54 is of a type which includes and is adapted to be driven by a motor, generally designated by the numeral 56, which is disposed in the sub 52 and is secured thereto such that the motor does not rotate relative to the drillstem 26 but does have a rotary output shaft 58 which rotates relative to the drillstem 26. The shaft 58 is preferably connected to a stabilizer member 60, which in turn is connected to a reduced diameter shaft 62 which extends downward and out of the lower distal end 53 of the sub 52. The lower portion of shaft 62 has suitably secured thereto an eccentric cylindrical cam or bearing member 64, see FIG. 4 also. The shaft 62 also extends beyond the bearing member 64 and includes a lower coupling part 68 which is adapted to be coupled to a conventional rotary drill bit 70. The bit 70 is of a type in which drilling fluid is conducted through suitable nozzle means 72 to flow into the pilot wellbore portion 11 being formed by the bit 70, as illustrated. The nozzle means 72 in the bit 70 is in communication with a passage 63 which extends through the shaft 62 including the coupling portion 68, the sub or stabilizer 60 and the shaft 58. A filter screen 74 is preferably interposed in the passage 63 at the nozzle means 72, as indicated, to prevent circulation of debris into the passage 63 during so-called reverse circulation for a purpose to be explained later herein.

The bit assembly 54 further includes a unique, generally cylindrical hole-enlarging cutting or reaming part 76 which has an eccentric bore 78 formed therein and which journals the bearing member 64. Suitable cutter buttons or inserts 79 are formed over a predetermined outer portion of the generally cylindrical cutter part 76 as indicated in FIGS. 2 and 4 through 6. The cutter part 76 is retained on the shaft 62 in the position shown in FIG. 2 by a reduced diameter flange portion 80 which engages the coupling part 68.

Figure 3:
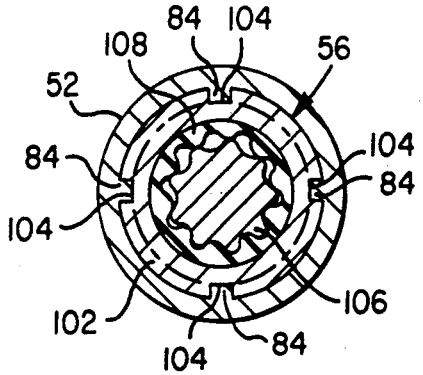
FIG. 3 is a section view taken generally from the line 3—3 of FIG. 2.
Figure 4:
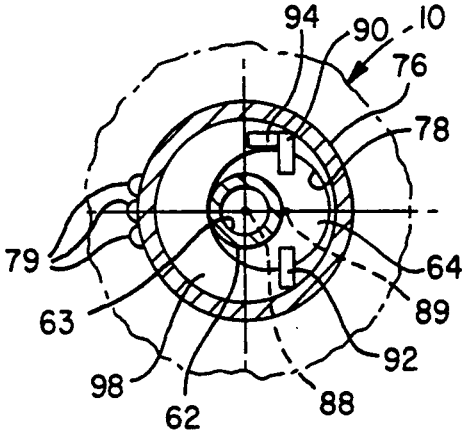
FIG. 4 is a section view taken from the line 4—4 of FIG. 2.

Referring also to FIG. 4, in both FIGS. 2 and 4 the cutter or reamer part 76 is shown in a centralized position which will permit insertion of and withdrawal of the bit assembly 54 with respect to the sub 52 and the drill stem 26 through the interior thereof. A minimum diameter of the sub 52 is defined by plural, longitudinal, inwardly-projecting keys or splines 84, FIGS. 2 and 3. In the position of the cutter or reamer part 76, in FIGS. 2 and 4, the outer surface on which the inserts 79 are formed is generally coaxial with the central longitudinal axis 88 of the bit assembly 54 and the drillstem 26. However, the bore 78 is eccentric with respect to the outer surface of the part 76 and is therefore displaced laterally with respect to the axis 88. In like manner, the central axis 89 of the bearing member 64 is eccentric with respect to the central axis of the shaft 62 which is also coaxial with the axis 88 of the bit assembly 54. As shown in FIG. 4, in particular, the bearing member 64 is fitted with spaced-apart stop members 90 and 92 which are adapted to engage a cooperating stop member 94 formed on the cutter part 76. The stop members 90, 92 and 94 are disposed in a recess in the cutter part 76 delimited by an upper transverse surface 96, FIG. 2, formed on the bearing member 64 and a transverse surface 98 formed on the cutter part 76.

Figure 5:
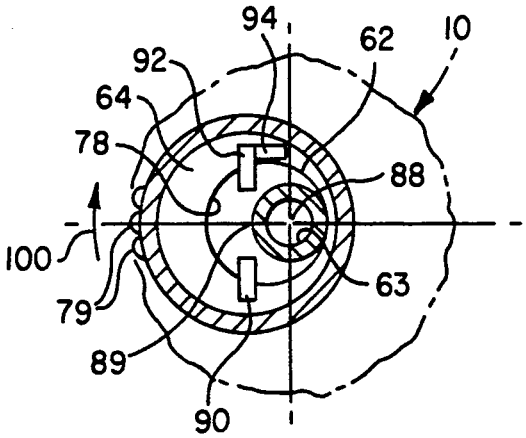
FIG. 5 is a view similar to FIG. 4 showing the reamer or cutter in its hole-cutting position.

In response to rotation of the shaft 62 in a clockwise direction, viewing FIGS. 4 and 5, the stop member 90 will move out of engagement with the stop member 94 while the shaft and bearing member 64 rotate about 180° to effect lateral movement of the cutter part 76 from the position of FIG. 4 to the position of FIG. 5, thanks to the eccentricity of the bore 78 and the bearing member 64 with respect to the axis 88. Accordingly, as the shaft 62 and bearing member 64 rotate from the position of FIG. 4 to the position of FIG. 5, the cutter part 76 will move laterally to a position such that the cutting elements or inserts 79 may cut a wellbore diameter to that of the wellbore 10 indicated in FIGS. 2, 4 and 5. This diameter is sufficiently large to permit formation of the annulus 42 and allow progress of the drillstem 26 into the wellbore as it is formed. Once the stop 92 has rotated into the position shown in FIG. 5 to engage the stop 94, further rotation of the shaft 62 and bearing member 64 relative to the cutter part 76 is arrested. Continued rotation of the shaft 62 in the clockwise direction rotates the bit 70 and the cutter part 76 in unison.

When it is desired to retrieve the bit assembly 54, the shaft 62 is rotated relative to the cutter part 76 in the direction opposite to that indicated by the arrow 100 in FIG. 5 until the cutter part moves back into a centralized position as shown in FIGS. 2 and 4. In this way, the bit assembly 54 may then be retrieved from the wellbore through the sub 52 and the drillstem 26 without removing the drillstem from the wellbore. Insertion and retrieval of the bit assembly 54 from the wellbore without removal of the drillstem 26 will now be described in conjunction with further description of the motor 56.

Referring further to FIGS. 2 and 3, the motor 56 includes a generally cylindrical outer casing 102 having a plurality of longitudinal grooves 104 formed on the periphery thereof and cooperative with the keys or splines 84 on the sub 52 to prevent rotation of the outer casing with respect to the sub 52 when the splines are engaged with the grooves. In the illustration of FIGS. 2 and 3, only four equally-spaced grooves 104 and splines 84 are shown, however, a larger number may be used to facilitate easy insertion of the motor housing 102 into the splined area of the sub 52. The motor 56 may be of the positive displacement internal gear type having a rotor 106 rotatable in a lobed stator 108. The type of motor illustrated is exemplary and various other types of downhole motors may be utilized in practicing the present invention. One type of motor which is suitable for use as the motor 56 is manufactured by Drilex Systems, Inc., Houston, Tex.

Referring to FIG. 2, pressure fluid such as drilling fluid is admitted to the motor 56 by way of a poppet-type check valve assembly 110 including a housing 112 and a closure member 114 which is closeable over an inlet port 115. In response to downward movement of the poppet closure member 114, viewing FIG. 2, pressure fluid is admitted into the interior of the housing 112 and may flow to motor inlet port means 116. Pressure fluid is exhausted from the motor 56 by way of an exhaust port 118 which is in communication with the passage 63 extending through the shaft 62, the stabilizer 60 and the output shaft 58 of the motor 56. A portion of the exhaust port 118 may be actually formed in the shaft 58. The valve body 112 includes sidewall inlet ports 120 which may be used for admitting fluid to the port 115 if a component such as an additional stabilizer, not shown, is added to the bit and motor assembly above the motor or if a wireline or coiled-tubing-type retrieval mechanism is utilized in inserting or removing the bit and motor assembly with respect to the drillstem 26. For example, a fishing head 117 may be secured to and above the valve housing 112.

As illustrated in FIG. 2, a resilient annular seal member 124 is disposed on the bit and motor assembly 54 between the motor housing 102 and the valve housing 112 and is engageable with a seal bore 126 formed on the sub 52 just above the splines 84. As illustrated, the seal 124 is formed with a transverse shoulder 127 which engages the upper ends of the splines 84 to locate the motor 56 in its proper position in the sub 52. A shoulder may also be formed on the sub 52 at the lower end of the splines 84, but not shown, to arrest downward movement of the motor 56.

Insertion of the bit and motor assembly 54 into the drillstem 26 and into its working position shown in FIGS. 2, 4 and 5 may be carried out by "pumping" the assembly down through the drillstem with drilling fluid after insertion of the assembly into the drillstem 28 and reconnection of the sub 30, kelly-cock 32 and swivel assembly 34 to the drillstem. If this method is used, the motor rotor 106 may be locked with a shear screw or the like, not shown, to prevent rotation of the motor shaft 58 during the insertion process due to pressure fluid acting thereon. Alternatively, the bit and motor assembly may be coiled-tubing-supported insertion and retrieval tool such as the type described in U.S. Pat. No. 4,856,582 to Smith et al and assigned to the assignee of the present invention. When the bit and motor assembly 54 are inserted into the drillstem 26 the reamer or cutter part 76 is in the position illustrated in FIG. 4, concentric with respect to the axis 88.

If the drillstem 26 is disposed in a previously-formed portion of the wellbore 10 and off the bottom of the wellbore by the amount illustrated in FIG. 2, the motor 56 will move into engagement with the sub 52 by the cooperating splines 84 and grooves 104 formed as described above until the seal 124 engages the seal bore 126. Application of drilling fluid by way of the conduit 40 down through the drillstem 26 will cause the valve closure member 114 to open to admit pressure fluid to the motor 56 to effect rotation of the shaft 62, bit 70 and the cutter or reamer part 76. As the cutter part 76 engages the formation material, continued rotation of the shaft 62 and the bearing member 64 will effect eccentric movement of the part 76 radially outward away from the axis 88 as the cutter inserts 79 commence to cut the wellbore 10 to the full diameter and until the stop 92 engages the stop 94 whereupon continued rotation of the bit 70 and shaft 62 in the direction of the arrow 100, FIG. 5, will effect cutting of the wellbore 10 to its full diameter to permit progress of the drillstem 26 downward and formation of a suitable annulus 42 for the return of drilling fluid and cuttings to the surface in a conventional manner. Drilling fluid exiting the motor 56 by way of the exhaust port 118 and the shaft passage 63 flows through the nozzle means 72 into the bottom of the wellbore to aid the wellbore forming action in a conventional manner.

When it is desired to retrieve the bit and motor assembly 54 from the wellbore, conventional retrieval mechanisms may be utilized or drilling fluid may be reverse circulated down through the annulus 42 and through the nozzle means 72, the passage 63 and the motor 56 to rotate the rotor 106 in the opposite direction. If reverse circulation is used to remove the bit and motor assembly 54 from the drillstem 26, drilling fluid is circulated through the conduit 44 and down through the annulus 42 to enter the nozzles 72. Debris and cuttings on the bottom of the wellbore 10 are prevented from entering the passage 63 by the screen 74. Prior to reverse circulation of the drilling fluid, conventional circulation should be continued to evacuate as much cuttings material from the bottom of the wellbore as possible. Moreover, the drillstem 26 should be raised off the bottom of the wellbore sufficiently to allow room around the bit 70 for reverse circulation and reverse circulation pressure should not exceed that of the formation fracture gradient.

During reverse flow of drilling fluid, the bit and motor assembly 56 are urged upward with respect to the sub 52 by pressure acting against the end face 103 of the motor housing 102. Drilling fluid also acts to rotate the motor rotor 106 in the opposite direction and as the eccentrically-disposed cutter part 76 engages the distal end 53 of the sub 52, enough drag will be imposed thereon to effect rotation of the shaft 62 and the bearing member 64 until the stop 90 engages the stop 94 and the cutter part 76 is again in a centralized position. Increasing the flow of drilling fluid in the reverse manner described above will also act on the valve closure member 114 sufficiently to effect closure thereof and the bit and motor assembly may then be "pumped" up the wellbore through the drillstem 26.

The motor inlet port 116 may also be sized appropriately to permit a pressure drop thereacross which, during insertion of the bit and motor assembly 54 into the wellbore 10, drilling fluid acting in the normal flow of direction will exert sufficient force on the motor housing 102 and seal 124 t o seat the motor fully in the sub 52 in the position illustrated in FIG. 2. This restriction in the inlet port 116 will also aid in the bit and motor retrieval action described above.

Figure 6:
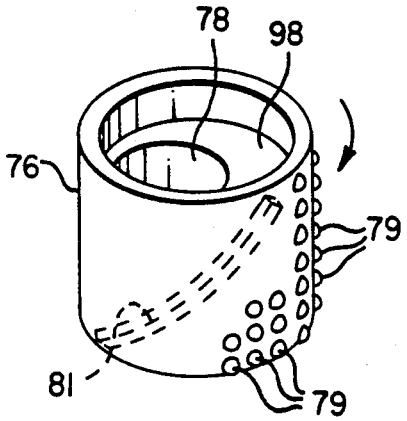
FIG. 6 is a perspective view of the cutter body.

Referring briefly to FIG. 6, the cutter member 76 may be modified to include one or more spirally-arranged scraping blades 81, one shown, formed on the outer surface thereof as illustrated to stabilize the cutter part during its normal operation. During reverse rotation or lifting of the bit and motor assembly 54 off of the bottom of the wellbore 10, the blades 81 will engage the wall of the wellbore 10 and effect rotation of the cutter part 76 from the position of FIG. 5 back toward the position of FIG. 4. The cutter inserts 79 may also be arranged in a somewhat spiral or helical pattern.

Conventional engineering materials used in downhole apparatus in the well drilling industry may be used to fabricate the components of the present invention. Although preferred embodiments of the present invention have been described in detail herein, those skilled in the art will recognize that various substitutions and modifications may be made to the invention without departing from the scope and spirit of the appended claims.

What is claimed is:

1. A retrievable bit assembly for use in drilling with one of drill pipe or drill casing in such a way that said bit assembly may be inserted in and removed from said drill pipe without removing said drill pipe from a wellbore, said bit assembly comprising:

fluid-driven motor means adapted for insertion in and traversal through said drill pipe to a lower distal end thereof, said motor means including a rotary output shaft;

cutter means connected to said rotary output shaft comprising a shaft member, bearing means connected to said shaft member and disposed eccentric with respect to the longitudinal central axis of said shaft member;

a cutter part disposed on said shaft member and engageable with said bearing means and movable from a position wherein said bit assembly may be inserted in or retrieved from said drill pipe without removing said drill pipe from a wellbore to a working position for enlarging the diameter of said wellbore; and cooperating stop means on said bearing means and said cutter part for delimiting eccentric movement of said cutter part in response to rotation of said shaft member.

2. The bit assembly set forth in claim 1 including:

seal means disposed on said bit assembly and engageable with a cooperating seal portion of said drill pipe for forming a substantially fluid-tight seal in said drill pipe between a surface of said drill pipe and a lower distal end of said drill pipe to provide for conducting pressure fluid through said drill pipe and said motor means.

3. The bit assembly set forth in claim 1 including:

means on said motor means cooperable with means on said drill pipe for inter-engagement to prevent rotation of said motor means relative to said drill pipe.

4. The bit assembly set forth in claim 1 including:

one-way valve means disposed on said bit assembly to permit flow of pressure fluid through said drill pipe to said motor means in one direction and operable to substantially prevent flow of fluid through said motor means and said drill pipe in the opposite direction to provide for removal of said bit assembly from said drill pipe under the urging of pressure fluid acting thereon.

5. The bit assembly set forth in claim 1 including:

stabilizer means interposed in said bit assembly between said motor means and said cutter part.

6. The bit assembly set forth in claim 1 including:

a pilot bit operably connected to said shaft member to be rotatably driven thereby to form a portion of said wellbore ahead of said cutter part.

7. The bit assembly set forth in claim 6 wherein:

said shaft member includes fluid passage means formed therein and in communication with nozzle means for ejecting drilling fluid into said wellbore, and debris-arresting screen means disposed over said nozzle means to prevent discharge of wellbore debris into said passage means during reverse circulation of fluid through said wellbore.

* * * * *